United States Patent [19]

Hale

[11] Patent Number: 4,656,962

[45] Date of Patent: Apr. 14, 1987

[54] BUOYANCY SUPPORT FOR DEEP-OCEAN STRUTS

[75] Inventor: Neville E. Hale, Mississauga, Canada

[73] Assignee: Fathom Oceanology Limited, Mississauga, Canada

[21] Appl. No.: 757,986

[22] PCT Filed: Oct. 9, 1984

[86] PCT No.: PCT/US84/01606

§ 371 Date: Jun. 11, 1985

§ 102(e) Date: Jun. 11, 1985

[87] PCT Pub. No.: WO85/01762

PCT Pub. Date: Apr. 25, 1985

[30] Foreign Application Priority Data

Oct. 12, 1983 [CH] Switzerland ..... 438833

[51] Int. Cl.[4] ..... E21B 7/12

[52] U.S. Cl. ..... 114/264; 114/265; 441/133; 166/350

[58] Field of Search ..... 114/266, 267, 264, 265, 114/293, 294; 441/133; 405/195, 200; 166/335, 355, 356; 175/6, 7; 37/72

[56] References Cited

U.S. PATENT DOCUMENTS 2,606,003 8/1952 McNeill ..... 175/7
3,017,934 1/1962 Rhodes ..... 114/267
3,359,741 12/1967 Nelson ..... 175/7
3,858,401 1/1975 Watkins ..... 175/7
3,992,889 11/1976 Watkins ..... 114/266

FOREIGN PATENT DOCUMENTS 1136545 11/1982 Canada ..... 114/266
1589637 5/1981 United Kingdom ..... 114/266

*Primary Examiner*—Sherman D. Basinger
*Assistant Examiner*—C. T. Bartz
*Attorney, Agent, or Firm*—Donald E. Hewson

[57] ABSTRACT

A long strut between a sea-platform and the ocean bed needs to have its weight supported. Otherwise, much of its strength is used merely in supporting itself. The strut disclosed is made in sections, joined typically by screw threads. The joints need to be inspected periodically. The hollow sections of the strut have their buoyancy disposed internally, yet with the joints exposed internally for inspection by a probe that passes down inside along the length of the strut. The vulnerable joint area is made accessible to the probe. When the joint area includes welds, they too are vulnerable and need to be inspected; the fact that the buoyancy forces also have to be fed into the strut at the joint areas makes for even greater difficulty in providing access for the probe to all the places that need to be inspected. This access is provided in the various manners as shown. The buoyancy may take the form of enclosures formed by welding diaphgrams into the sections, or of separate air-canisters positioned inside the sections and made of plastic.

10 Claims, 10 Drawing Figures

BUOYANCY SUPPORT FOR DEEP-OCEAN STRUTS

FIELD OF THE INVENTION

This invention relates to a manner of giving buoyancy support to structures that extend down to great ocean depths.

For the recovery of resources from beneath deep water, forces have to be transmitted from a working platform at the surface to a point on the sea-bed. These forces sometimes may be tensile, sometimes rotary, sometimes compressive. The platform may be in position only temporarily or it may remain there more or less permanently.

When the water is very deep, the length of the strut can be such that most of the strength of the material of the strut goes in supporting its own weight. In such a case, it has been proposed to offset the weight of the strut by providing buoyant support, so that the material of the strut can all be used for carrying useful forces from the platform to the sea-bed.

PRIOR ART

Such a system is that shown in HALE, et al, Canadian Pat. No. 1,136.545, issued Nov. 30 1982. Briefly, this system involves the placing of a large number of hollow canisters along the height or length of the strut. Each canister is effectively open at the bottom, and closed at the top.

The canister is provided with a tube that has a port near the bottom of the canister. When the canister is almost full of air (so that the water in it is almost completely expelled) the port becomes uncovered and further air fed into the canister enters the tube. This extra air is received into the tube and directed by it pipe to a point from which it bubbles up into the next canister above. Air fed into the bottom-most of a vertical series of canisters therefore fills each canister in turn, in cascade from the bottom up.

A huge advantage of this system is that the air pressure in each canister is the same as that of the water that surrounds it; each canister, whatever its depth, can therefore be a mere container and not a pressure vessel. So long as air is initially pressurized sufficiently to force it against the water pressure into the bottom-most canister, air will cascade up through all the canisters in the manner described, and its pressure will be automatically equalized with that of the water at every one of them.

This system may be described as a "cascading-canister" system, and has become known as the CASCAN (TM) system.

BACKGROUND OF THE INVENTION

Struts for ocean platforms are made in prefabricated sections, to be assembled together during final deployment. The assembly process must be done quickly, since the predictable weather window, in which deployment must be completed, is, in those deep oceans of the world where resouces are thought to exist, hardly ever more than two or three days. There is no time for a vigorous inspection procedure, during assembly. There is a need therefore to inspect the strut periodically during its service life.

For this reason, it is preferred that the strut be hollow, so that an inspection device may be lowered internally down the strut.

To describe it in more detail, the inspection procedure comprises sending an ultrasonic send-and-receive transducer down the strut. The transducer moves down in a predetermined spiral, and transmits a trace that can be recorded, and compared with previous traces, to give an early warning of possible weakening of the strut. Ultrasonic measurements of the kind required can only be carried out reliably and economically if the surface of the metal being tested is under water, since ultrasonic signals in air are swamped with noise.

This requirement for internal inspection would seem to rule out the possibility of using the actual walls of the strut to form the canisters for holding the buoyancy air, since the air would block the signals.

However, it is recognized in the invention, that the main critical area of the strut from the point of view of potential weakening, is the area of the joints between the sections of the strut. It is recognized that an inspection procedure that just examined the joints would be quite adequate, since the possibility of a gradually worsening, detectable fault developing in the main length of the section is very remote.

DESCRIPTION OF THE INVENTION

In the invention, a section of the strut has an air-canister, the buoyancy forces of which are transmitted to the section. The canister has two tubes, through both of which fluids may pass from below the canister to above the canister. One of the tubes is a cascade tube and is located in such a way that air emerging from a cascade tube cannot enter directly the cascade tube above it: the air must fill the canister before it can enter the next cascade tube above. The other tube is an inspection tube and it, on the contrary, is mounted so as to be in alignment with the inspection tubes above and below it, to allow the passage of a probe down the inspection tubes of each section, from top to bottom of the strut. In the invention, the area of the joint between the sections is flooded, to allow ultrasonic inspection of the joint to take place. The probe is made to pause at each joint, and scan the joint, before passing on to the next one. The invention leaves the joint uncluttered with anything inside the strut in the joint space that could interfere with the free scanning movement of the probe.

With the invention it now becomes feasible to use the walls of the hollow sections themselves as the containers or canisters for the buoyancy air.

The requirements that are catered for by the apparatus of the invention may be summarized as:

(a) No part of the permanent structure of the strut occupies the space inside the joint area between the sections, which allows free access to the walls of the sections from inside by the transducer;

(b) The space inside the point area between the sections is permanently flooded, for interference-free operation of the transducer;

(c) The permanent structure of the strut needs no moving parts, neither to allow air to be cascaded up the strut, nor to allow the transducer to be passed up and down the strut;

(d) Virtually all the construction of the strut can be done during manufacture of the sections, leaving just a screw-together operation to be done when deploying the strut.

The sections of the strut will normally be circular. It is convenient therefore that the inspection tube, down which the transducer will pass, is concentric with the walls of the section so that the inspection tubes of all the sections are always vertically aligned. The cascade tube is displaced radially from the inspection tube, and it can be arranged conveniently enough that the means for preventing vertical alignment between the respective cascade tubes of the sections comprises respective frames that hold the bottoms of the cascade tubes at a different radius from their tops.

With the invention, it becomes economically possible to construct a platform for deep ocean use which is anchored to the sea-bed by tension struts. The struts are arranged to hold the platform down in the water against its own buoyancy, a construction which gives a platform of great stability, and a construction which is reliable and safe substantially permanently. Such a platform is called a tension-leg-platform (TLP).

DETAILED DESCRIPTION OF PREFERRED EMBODIMENT

The invention will now be further described by way of example, with reference to the accompanying drawings.

Figure 1:
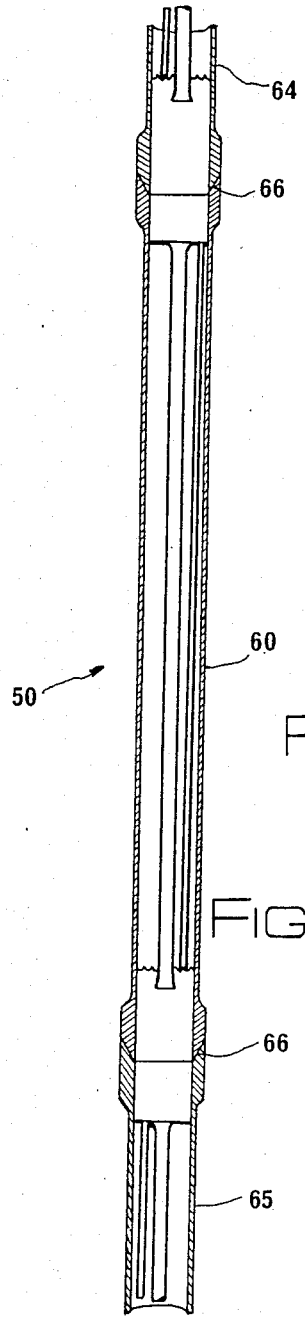
FIG. 1 shows part of a tension-bearing strut of a TLP.

FIG. 1 shows a section 60 of a strut 50, together with part of the section 64 immediately above, and of the section 65 immediately below. The strut 50 is of high strength stainless steel and is part of a tether for a tension-leg-platform. The strut 50 extends from the platform, down to the bottom of the sea and is in a constant state of tension. All the sections of the strut are nominally identical, and reference numerals apply to every section unless otherwise stated.

The interfaces 66 at which the sections 60,64; 60,65 are joined together are in the form of screw threads. These threads, and the steel surrounding them, are somewhat vulnerable to gradually-developing faults, to the extent that it is desirable to subject the interfaces or joints 66 to inspection from time to time to gain an early warning of such a fault. The inspection can be carried out by passing an ultrasonic inspection probe 67 (FIG. 3) over the inside surface 68 of the steel walls 69 of the section 60, providing the surface 68 is at the time submerged under water.

Into each of the sections 60 is welded a respective diaphragm 70. The diaphragm 70 has two holes in it, into which are welded respectively an inspection tube 71 and a cascade tube 72. The diaphragm 70 is sealed to the section 60 such that fluids cannot pass from below the diaphragm 70 to above the diaphragm 70 except through the tubes 71,72.

The space 73 below the diaphragm 70 can be filled with air, which cannot escape from that space 73 except by entering the bottom port 74 of the cascade tube 72. Since the port 74 of the cascade tube 72 is at a higher level than the port 75 of the inspection tube 71, excess air from the space 73 under the diaphragm 70 will enter the cascade tube 72, not the inspection tube 71.

Figure 2:
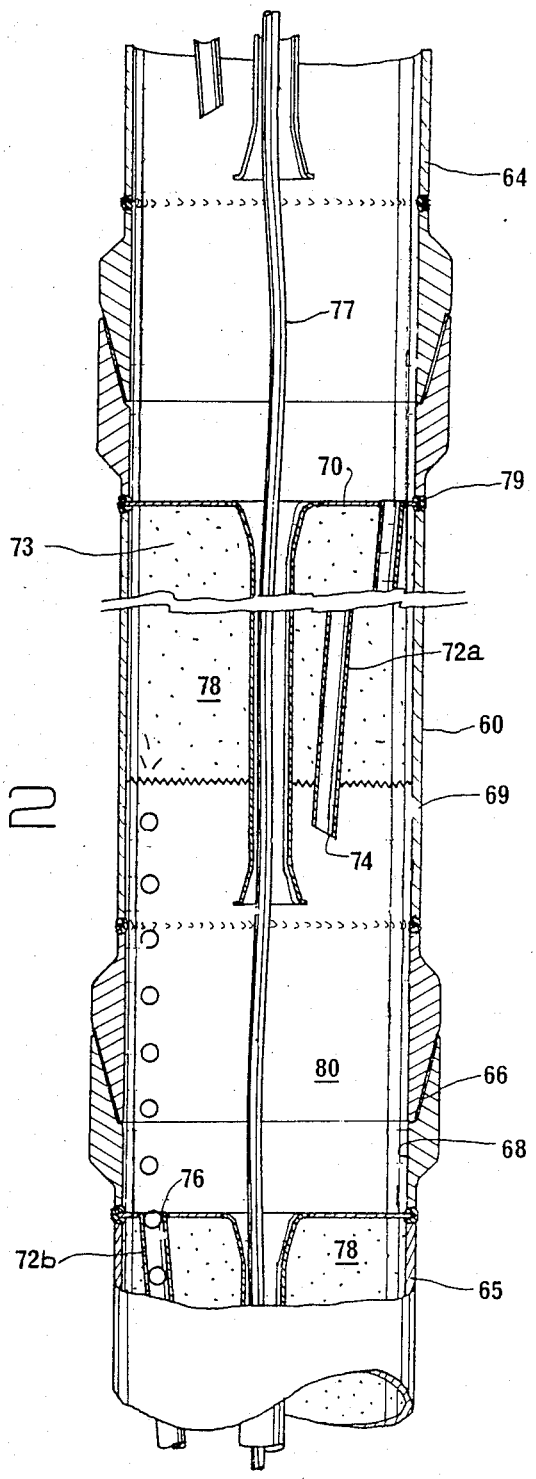
FIG. 2 is a view of part of the strut when the strut is being charged with air.

FIG. 2 shows air being fed upwards from the exit port 76 of a cascade tube 72*b* below. This air enters the space 73 under the diaphragm 70 so that the space under the diaphragm 70 and enclosed by the walls 69 of the section 60 comprises an air canister 78. The air forces out the water in the canister 78 until the air fills the whole of the canister 78 right down to the level of the bottom entry port 74 of the cascade tube 72*a*. Any further air received from the cascade tube 72*b* below into the canister 78 therefore goes into the cascade tube 72*a* and thence into the next section 64 above. The whole strut 50 is charged with air in this manner, in cascade, section by section. Air is fed from an air compressor at the surface to the bottom-most section through an air-hose 77.

Buoyancy forces due to the air in the canister 78 are transmitted to the strut through the weld 79 by which the diaphragm 70 is attached to the section 60.

The pressure of the air is exactly equal to the pressure of the water at the interface between them, i.e., at the level of the port 74. Although all the air in the canister 78 is at that pressure, the water pressure outside the canister 78 decreases towards the top of the canister. The height of the section 60 may be such as to give rise to a pressure differential between the air inside and the water outside at the top of the canister 78 (i.e., at the level of the diaphragm 70) of around 1 or 1½ atmospheres. The pressure of the buoyancy air thus is automatically set and controlled, and differs from the water pressure by no more than that small amount mentioned, at whatever depth the section 60 is located. No matter how deep the water, the buoyancy air pressure is substantially in balance with the water pressure.

The disposition of the top ends of the tubes 71,72 is controlled by their locations in the diaphragm 70. A spider frame 81 (FIG. 4) is provided for the purpose of locating the bottom ends of the tubes 71,72. By this means, the tops of the cascade tubes 72 can be located at a different radius from the bottoms of the cascade tubes 72, and hence air exiting from the top exit port 76 of a cascade tube 72*b* cannot enter directly the cascade tube 72*a* above it, but must bubble up directly into the canister 78 above. And, of course, air from a cascade tube 72 cannot enter an inspection tube 71. FIG. 2 illustrates this aspect.

The space 80 inside the strut 50 between air canisters 78 is flooded with water. The joint interface 66 between two sections is, it will be noted, in this space 80. It will be noted also that there is nothing else in the space 80. The canisters, tubes, and all other parts of the structure, do not obtrude into this joint space, leaving the inside surfaces 68 of the walls 69 of the strut bare and accessible for inspection.

Figure 3:
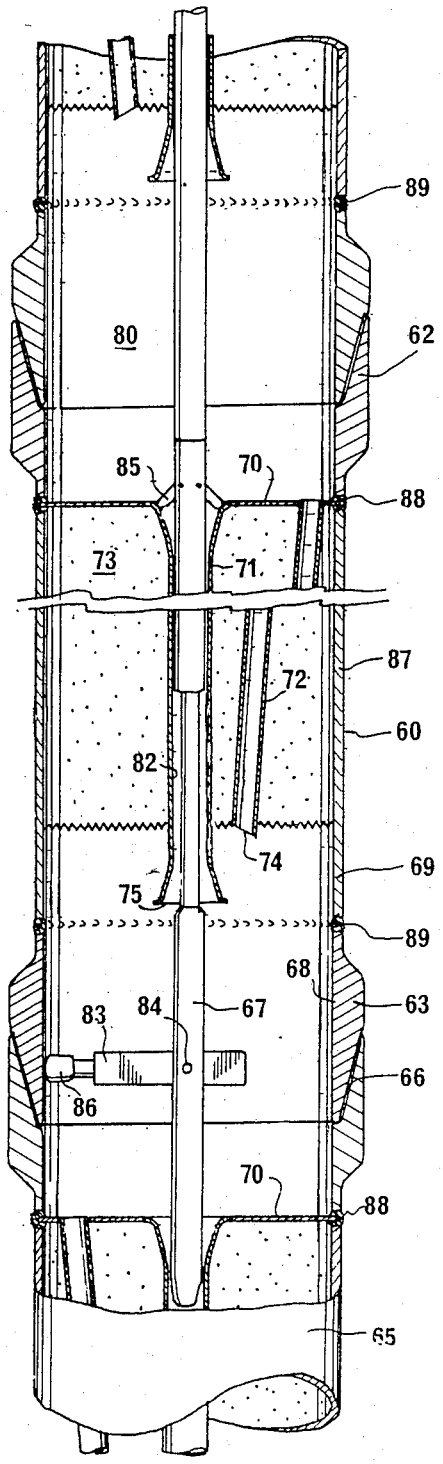
FIG. 3 is a diagrammatic view of a joint of the strut during an inspection.

As shown in FIG. 3, an inspection probe 67 is passed down the inspection tube 71. The inspection tube 71 has a typical diameter of 20 cm, so that the probe 67 must be able to pass through that diameter, with a sufficient allowance to prevent snagging, even if the inward-facing surface 82 of the tube should be somewhat fouled, and bearing in mind that the probe 67 has to be lowered, controlled, and recovered, from the platform at the surface.

The probe 67 includes a scanning arm 83 which is mounted on a pivot 84. It also includes a locking arm arrangement 85 which is mounted for pivoting. When the probe 67 is moving up and down the strut, the arms 83,85 are folded lengthwise with respect to the strut. When the probe 67 reaches a scanning position (as in FIG. 3) the arms 83,85 move to the positions shown. The probe 67 contains means to move the scanning arm 83 in a pre-determined spiral path over the surfaces of the walls in the joint space 80. The scanning arm 83 includes a resilient means for urging the ultrasonic head 86 into contact with the steel walls 69 of the strut. The spiral motion of the scanning arm 83 is reacted against the locking arm 85, which engages the diaphragm 70 in a manner which locks the arm 85 to the strut 50.

The probe 67 is lowered from the platform, and it may alternatively be arranged that the reaction to the rotation of the scanning arm 83 be taken at the platform.

The probe 67 may be as sophisticated as desired: it is withdrawn from the strut 50 after each inspection, and has no requirement to remain inaccessibly submerged for many years, as have the sections of the strut. The sections of the strut are so inaccessible that if a fault is in fact detected during the inspection, it is most unlikely that anything could be done to repair it. The remedy would be that some of the tension in the defective strut would be relieved (and shed onto the other struts of the TLP) to avoid a sudden failure.

The sections of the strut shown in FIGS. 1, 2 and 3 have had a middle portion 87 that is a simple right-cylinder, to which threaded end portions 62,63 are joined be welding. It will be noted that at a particular joint, the weld 89 above may be inspected in the same manner as the joint interface 66. The weld 88 below however, is rather more difficult since the diaphragm 70 cuts off access to all but the very top of the weld 88. (The weld 79 between the diaphragm 70 and the section is in this case unitary with the weld 88.) And below the diaphragm 70 is air, which acts as a more or less perfect reflector of ultrasonic waves, denying them any penetration into the critical area of the weld 88 below the diaphragm 70.

The welds 89,88 are pre-fabricated under whatever strictness of control is deemed economically desirable, so that the requirement for inspection once the section is submerged may not be so great. However, obviously the welds are critical to the tension-supporting capability of the strut, and the following alternative constructions of the strut show how the problem of weld inspection may be alleviated.

Figure 4:
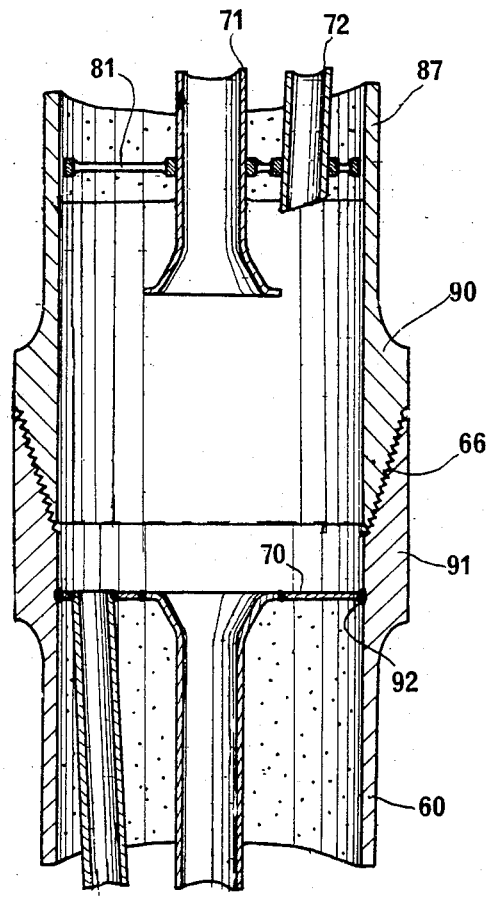
FIG. 4 is a view of a joint between sections of another strut.

In FIG. 4, the sections of the strut have forged or upset ends 90,91 on which the joints are formed, so that no weld is required. It may be assumed that the transition from the thin-walled cylindrical middle portion 87 of the section is no more vulnerable than the rest of the main part 87 (i.e., barely vulnerable at all) and therefore the inspection may be confined purely to the joint 66 itself. The diaphragm 70 is welded to the section 60 at a place 92 where the section 60 is thick, and therefore that weld can be trusted not to have weakened the strut at all.

However, forging the ends of the section in one piece with the rest of the section is a much more expensive manner of constructing the section than forming the ends separately and welding them on.

Figure 5:
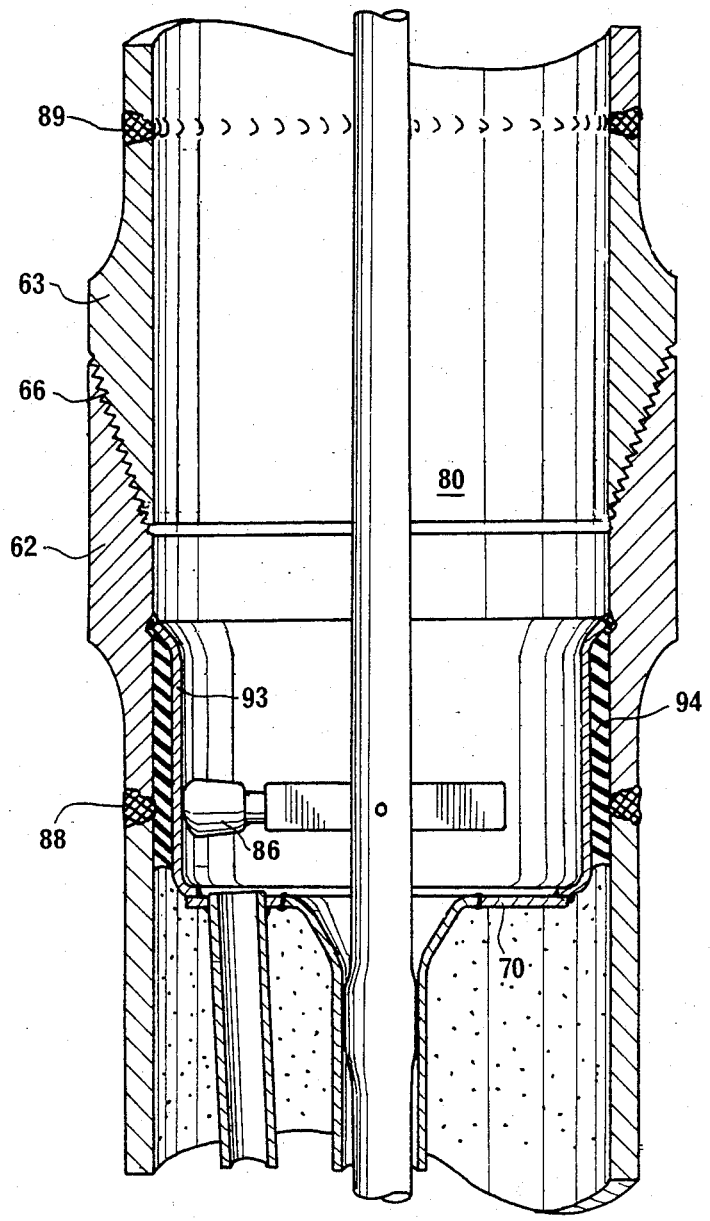
FIG. 5 is a view of a joint between sections of a further strut.

FIG. 5 shows how the weld 88 below a joint may be inspected in the same manner as the joint 66 itself. During the manufacture of the section, a collar 93 was welded to the end portion 62, at a place where the steel is thick and therefore where the weld can be trusted to have left no weakening effect. The diaphragm 70 has not at this point been installed. The space 94 behind the collar 93, i.e., between it and the region of the section that contains the weld 88, is packed with a polyurethane elastomer that reacts to ultrasonic waves as if it were sea-water; i.e., its acoustic impedance matches that of sea-water.

The ultrasonic inspection head 86, when located as shown in FIG. 5, sends its signals through the collar 93, through the elastomer, into the weld 88, and picks up their reflections. Providing the collar 93 is relatively thin, a developing fault in the weld 88 may be detected in this manner.

Once the elastomer is installed, and has set, and has been inspected during manufacture, the diaphragm 70 may be welded to the collar 93. If the collar 93 and the diaphragm 70 were in one piece, the elastomer would have to be installed from the remote end of the section 60, which would be very inconvenient, (though not impossibly so).

A suitable polyurethane elastomer is that sold under the trade name "Conathane E5".

Figure 6:
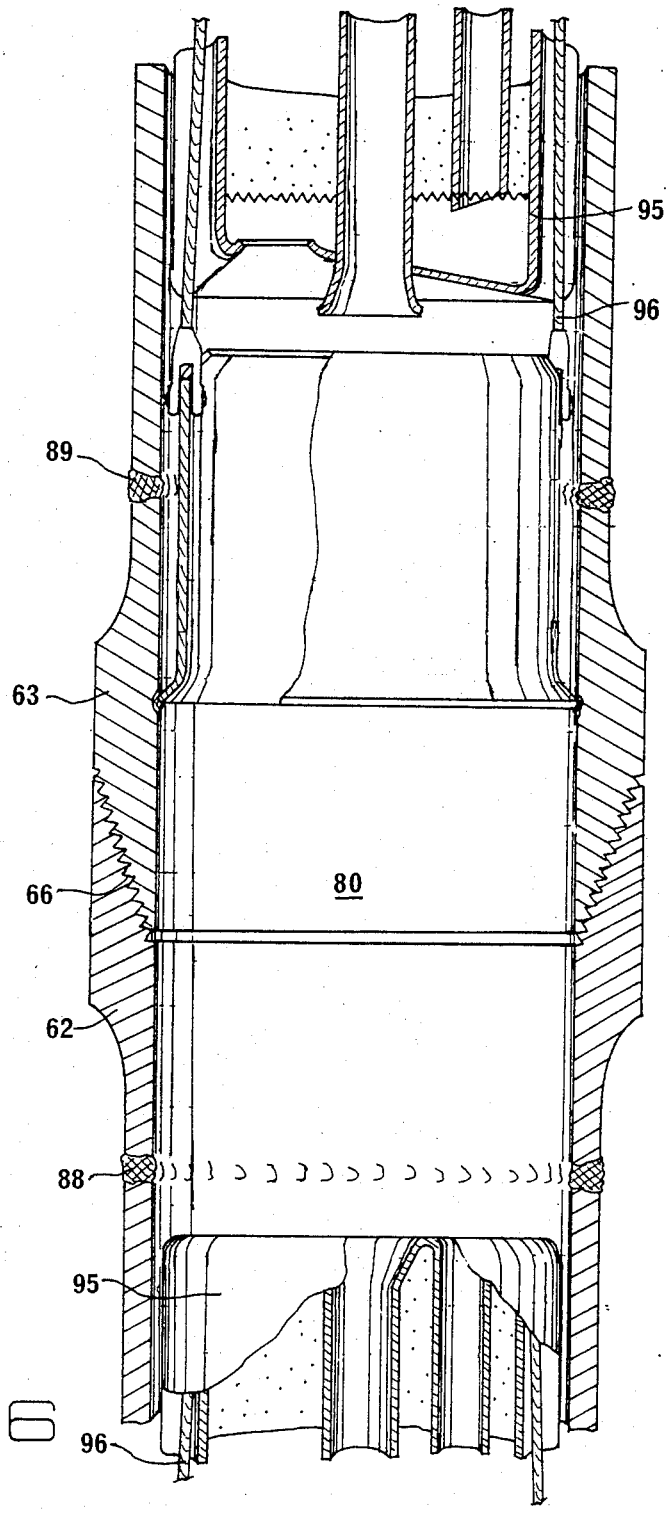
FIG. 6 is a view of a joint between sections of yet a further strut.

As shown in FIG. 6, instead of the air canister being formed by a welded-in diaphragm and the walls of the section, the canister might be separate from the section, and be made, for example, of a plastic material. In such a case, it is convenient if the buoyancy forces from the separate canister 95 are transmitted to the section 60 by means of tension cords 96. An analogous constraint now arises in the case of the critical weld 89 above the joint interface 66: if the cords 96 were to be attached to the section walls above the critical weld 89, the attachment means could not be trusted not to have weakened the walls; if the cords 96 were to be attached to a "safe" place, i.e., to the thicker material below the critical weld 89, the cords 96 would interfere with the free access of the inspection head 86 to the critical weld 89.

In the FIG. 6 embodiment the inclined bottom end of canister 95 has the lower end of a cascade tube located directly overlying the inclined bottom, which serves as a masking means to prevent direct entry of air from an underlying cascade tube into the overlying tube.

The use of a relatively thin collar that is attached to the "safe" area but extends past the weld, is again employed, as shown in FIG. 6. The elastomer is not needed this time because the space between the collar and the weld naturally remains under water. The collar, and indeed all the components, should be designed so as to permit the probe to traverse smoothly in the inspection area, and so that air does not become entrapped in the joint space 80.

Figure 7:
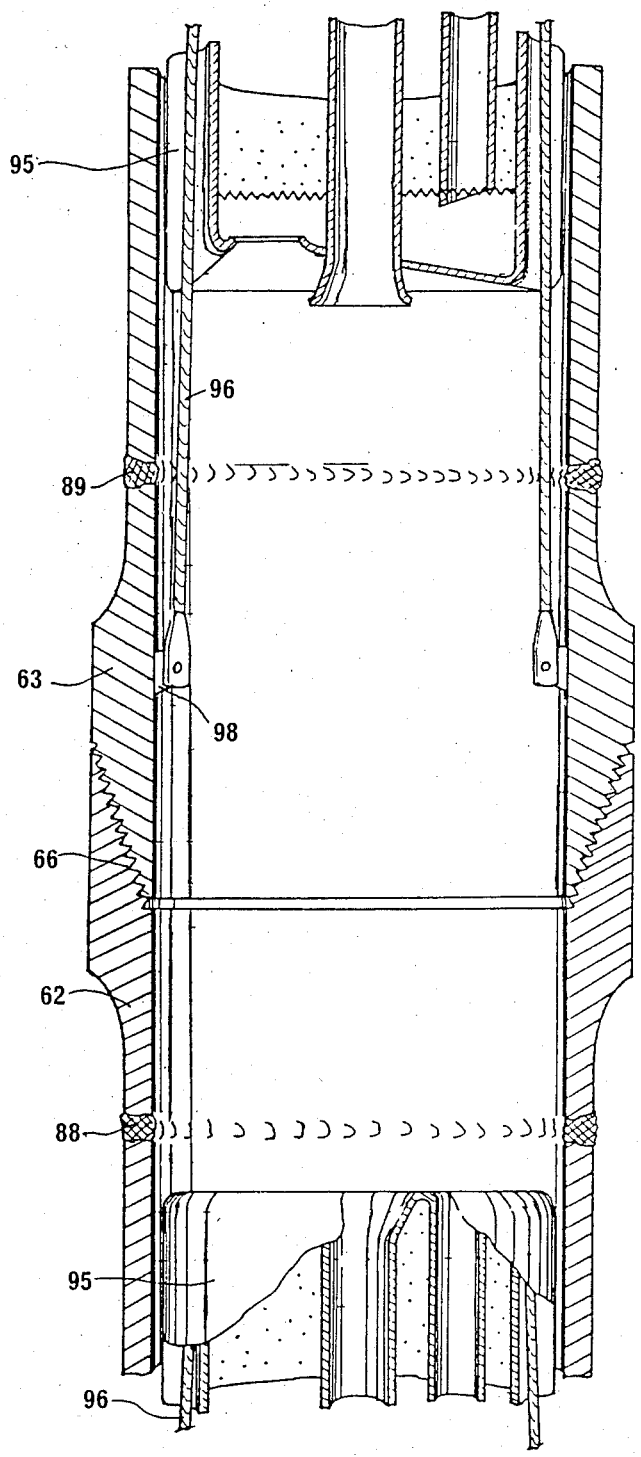
FIG. 7 is a view of a joint between sections of still another strut.

In fact, it is possible for the collar to be not present, and for the cords 96 to extend down below the weld 89. Now, the probe 67 has to be very sophisticated, because it has to sense the presence of a cord and traverse past it. But it is possible to arrange for it to do so and to leave hardly any of the weld 89 un-inspected. This alternative is shown in FIG. 7, where the cords 96 are secured to lugs 98 that are welded in the "safe" area.

Figure 8:
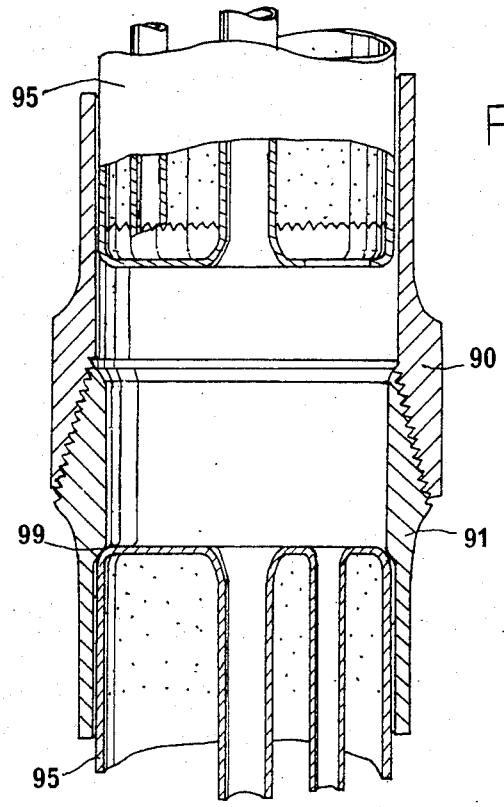
FIG. 8 is a view of a joint between sections of yet another strut.

In the alternative shown in FIG. 8, the upper end portions 91 of the sections are swaged inwards to provide a respective flange 99 that a canister 95 may float against, to transmit the buoyancy forces to the section.

No welds are required at all in this case, and inspection of the joint interface 66 is thus very easy. In a variation of this alternative (not shown) the lower end portion (63) of the section may be welded on, since that weld (89) could be easily inspected. Instead of the cascade tubes being mis-aligned radially, the canister can have a bottom that acts to mask its own cascade tube, and prevent air entering directly from the cascade tube below.

Figure 10:
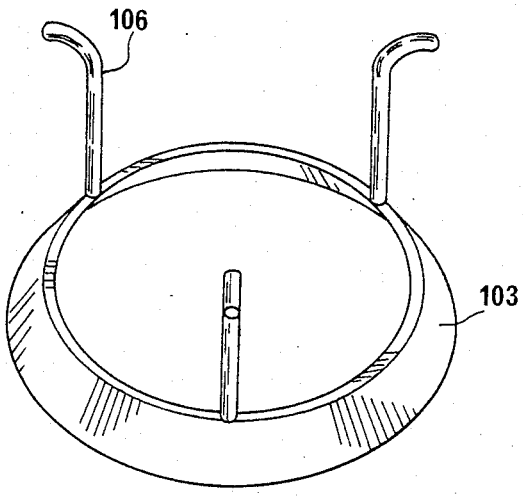
FIG. 10 is a pictorial view of a component of the section shown in FIG. 9.
Figure 9:
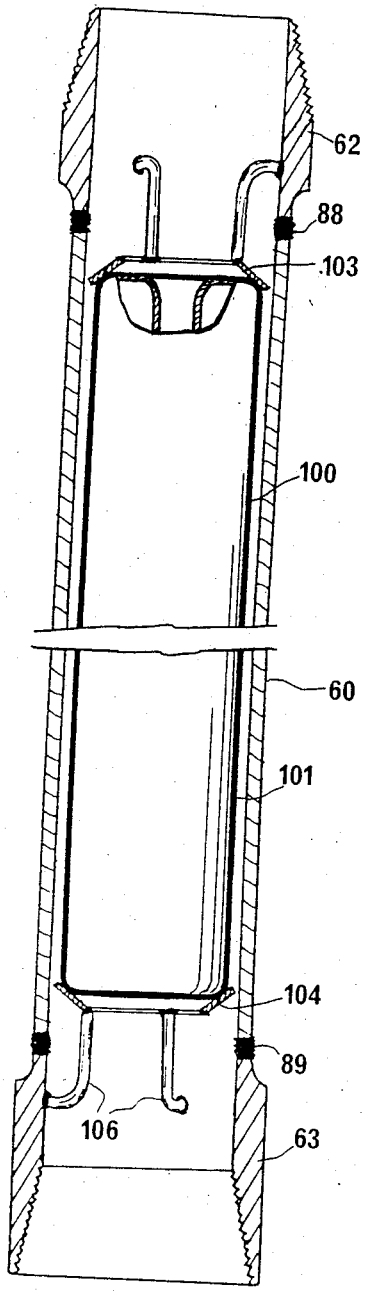
FIG. 9 is a sectional view of a section of yet a further alternative strut.

FIGS. 9 and 10 show an alternative embodiment which again makes use of plastic canisters. The economics of productions indicate that it is better to have two plastic canisters per section of the strut.

The two canistes 100,101 are mounted between two flange plates 103,104 located one at either end of the section 60. The flange plates 103,104 are attached to rods 106 which can be welded to a "safe" part of the thickened ends 62,63 of the section.

The rods 106 are of round section, and bent and angled as shown for the purpose of allowing air to flow freely around the rods 106 (and around the plates 103,104). No air can be trapped under the rods or under the welds.

Also, the rods 106 are well spaced from the section walls to allow access for inspection of the weld between the rod and the wall. This same access space can be used to allow a protective coating to be applied to the steel surface after welding, and for that surface too to be inspected.

The rods 106 also are long, so as to locate the flange plates 103,104 well away from the critical welds 88,89, to allow the probe to inspect those welds. The fact that the rods are long is also helpful in that the heat from welding the rods to the wall does not reach the plastic material of the canister.

The presence of the rods means that the probe has to be sophisticated enough to traverse around the rods to inspect the welds, as was the case with the cords in the FIG. 7 embodiment.

As may be seen from FIG. 9, the section with its canisters is a completely self-contained unit. The whole assembly may be made and inspected in the factory. The unit is easy to transport, and to deploy the strut the only operation needed is to screw the sections together.

As shown, the canisters 100,101 may float upwards until the top canister rests against the flange plate 103, and the bottom canister 101 rests against the top canister 100. Alternatively, one or both of the canister may be constrained by cords to the bottom flange plate 104.

The struts described have been closed, i.e., the water inside the strut is not in communication with the water outside. This can be useful if, for example, an anti-corrosion or anti-fouling additive needs to be added to the water inside. However, the water inside should have exactly the same density as sea-water, as otherwise differential pressures could develop. To ensure complete pressure equalization, holes may be formed in the sections (in the thickened joint area) so that the water inside is open to the sea.

The inspection probe need not be exclusively an ultrasonic device. It might include a T.V. camera, or other suitable apparatus.

It will be noted that, even though the inspection probe needs to be very sophisticated, there is nothing on the strut itself to break down or seize up or go wrong in some other way. Deep-water TLP's depend for their viability on the use of very reliable yet inexpensive struts, and the manner of constructing and arranging the struts as described herein helps to make it practically possible for a tension-leg-platform to become a reality.

I claim:

1. Apparatus for transmitting forces between two points that are widely separated vertically by a body of deep water, the apparatus comprising a strut and a buoyancy means for supporting the weight of the strut, characterized by the following structural arrangement;

(a) the strut has hollow circular cylindrical wall sections that are joined together end-to-end at respective interfaces, the respective spaces enclosed inside the hollow interior of the strut and extending above and below the respective interfaces being termed the respective joint spaces, each section having a middle portion and two respective end portions welded to the ends of the middle portion;

(b) sections of the strut are provided each with a one or more respective air containing canisters comprising a diaphragm welded to said section walls, and said middle portion walls, and a respective canister attachment means, each of the canisters having a respective inspection tube and inspection tube location means locating the inspection tube concentrically with said cylindrical wall, and a respective cascade tube and cascade tube location means locating said cascade tubes radially offset relation;

(c) the canister attachment means is arranged to receive buoyancy forces of the one or more respective canisters and transmit those forces to the section;

both tubes having respective ports at either end and pass through the canister, and are open to the passage of fluids from beneath to above the canister;

(d) the bottom port of the inspection tube is situated at a lower level vertically than the bottom port of the cascade tube;

(e) means are provided for positioning the adjacent ends of adjacent cascade tubes in offset mutually non-aligned relation so as to prevent, in use, the upward passage of air emerging from a lower tube directly outward into the next-above cascade tube;

(f) the inspection tube location means is effective to hold an inspection tube of a section in alignment with the inspection tubes of the sections immediately above and below, so that a probe in following a path straight through in an inspection tube enters directly into the inspection tube of the adjacent section; and wherein:

(g) the arrangement is such that air does not become entrapped in the joint space, so that the joint space, once flooded, remains flooded with water; and (h) the canisters, the tubes, and their respective attachment means, substantially do not obtrude into the respective joint spaces, so that an inspection probe may be traversed over substantially all of the inside surfaces of the sections in the joint space substantially without restriction

2. Apparatus of claim 1, wherein the means for preventing air from emerging from one cascade tube directly into another comprises masking means placed in vertical alignment with and below the bottom port of a cascade tube.

3. Apparatus of claim 1, wherein the cascade tube location means and the inspection tube location means together are comprised by, at the upper ends of the tubes, the said diaphragm, which has respective holes into which the tubes are fixed, and, towards the lower ends of the tubes, a spider frame which locates the tubes with respect to each other and to the section, yet which does not interfere with the free vertical movement of the fluids.

4. Apparatus of claim 1, wherein sections of the strut are provided each with only one respective air containing canister.

5. Apparatus of claim 1, wherein tension cords are attached to lugs welded on an end portion of the section which are remote from the weld between the end portion and the middle portion, to transfer buoyancy forces from a said canister to a said section.

6. Apparatus of claim 1, wherein the diaphragm includes a relatively thin collar, and the collar is welded to the section at a point on the end portion remote from the weld between the end portion and the middle portion, and wherein the space between the collar and the said weld is packed with a material having substantially the same acoustic impedance as water.

7. Apparatus of claim 1, wherein the section is right-cylindrical, and uniform along its length, except that end portions of the section are forged or upset to a thickness greater than an integral middle portion of the section.

8. Apparatus for transmitting forces between two points that are widely separated vertically by a body of deep water, the apparatus comprising a strut and a buoyancy means for supporting the weight of the strut, characterized by the following structural arrangement;

(a) the strut has hollow circular cylindrical wall sections that are joined together end-to-end at respective interfaces, the respective spaces enclosed inside the hollow interior of the strut and extending above and below the respective interfaces being termed the respective joint spaces, each section having a middle portion and two respective end portions welded to the ends of the middle portion;

(b) sections of the strut are provided each with a one or more respective air containing canisters that are separate from the walls of the section, and made of plastic and are contained between two flange blades, one at each end of the section, and a respective canister attachment means, each of the canisters having a respective inspection tube and inspection tube location means locating the inspection tube concentrically with said cylindrical wall, and a respective cascade tube and cascade tube location means locating said cascade tubes in radially offset relation;

(c) the canister attachment means is arranged to receive buoyancy forces of the one or more respective canisters and transmit those forces to the section;

both tubes having respective ports at either end and pass through the canister, and are open to the passage of fluids from beneath to above the canister;

(d) the bottom port of the inspection tube is situated at a lower level vertically than the bottom port of the cascade tube;

(e) means are provided for positioning the adjacent ends of adjacent cascade tubes in offset mutually non-aligned relation so as to prevent, in use, the upward passage of air emerging from a lower tube directly outward into the next-above cascade tube;

(f) the inspection tube location means is effective to hold an inspection tube of a section in alignment with the inspection tubes of the sections immediately above and below, so that a probe in following a path straight through in an inspection tube enters directly into the inspection tube of the adjacent section; and wherein:

(g) the arrangement is such that air does not become entrapped in the joint space, so that the joint space, once flooded, remains flooded with water; and (h) the canisters, the tubes, and their respective attachment means, substantially do not obtrude into the respective joint spaces, so that an inspection probe may be traversed over substantially all of the inside surfaces of the sections in the joint space substantially without restriction.

9. Apparatus of claim 8, wherein the flange plates are located in the section by rods that are of such dimensions as to space the plates well clear of the joint spaces and so shaped as to resist the formation of air pockets in the joint space.

10. Apparatus of claim 8, wherein the cords are attached to a collar at a point above the said weld, and the collar is attached to the end portion at a point below, and remote from the said weld.

* * * * *

UNITED STATES PATENT AND TRADEMARK OFFICE

CERTIFICATE OF CORRECTION

PATENT NO. : 4,656,962

DATED : April 14, 1987

INVENTOR(S) : Neville E. Hale

It is certified that error appears in the above-identified patent and that said Letters Patent is hereby corrected as shown below:

Title page:

--[30] Foreign Application Priority Data

Oct. 12, 1983 [CH] Switzerland.....438833-- should read

"Oct. 12, 1983 [CA] Canada .....438833"

Signed and Sealed this

Sixth Day of October, 1987

*Attest:*

DONALD J. QUIGG

*Attesting Officer*

*Commissioner of Patents and Trademarks*